US012024971B2

(12) United States Patent
Dallas et al.

(10) Patent No.: US 12,024,971 B2
(45) **Date of Patent: *Jul. 2, 2024**

(54) WEAR-RESISTANT ANNULAR SEAL ASSEMBLY AND STRADDLE PACKER INCORPORATING SAME

(71) Applicant: Exacta-Frac Energy Services, Inc., Conroe, TX (US)

(72) Inventors: Lloyd Murray Dallas, Streetman, TX (US); Joze John Hrupp, Montgomery, TX (US); Ahmed Mohamed Saeed, Cypress, TX (US)

(73) Assignee: Exacta-Frac Energy Services, Inc., Conroe, TX (US)

( * ) Notice: Subject to any disclaimer, the term of this patent is extended or adjusted under 35 U.S.C. 154(b) by 118 days.

This patent is subject to a terminal disclaimer.

(21) Appl. No.: 17/669,490

(22) Filed: Feb. 11, 2022

(65) Prior Publication Data

US 2022/0268123 A1 Aug. 25, 2022

Related U.S. Application Data

(63) Continuation-in-part of application No. 17/179,593, filed on Feb. 19, 2021, now Pat. No. 11,473,393.

(51) Int. Cl.
*E21B 33/12* (2006.01)

(52) U.S. Cl.
CPC ..... *E21B 33/1208* (2013.01)

(58) Field of Classification Search
CPC ..... E21B 33/1208; E21B 33/124
See application file for complete search history.

(56) References Cited

U.S. PATENT DOCUMENTS

| | | | | |
|---|---|---|---|---|
| 6,354,372 | B1 * | 3/2002 | Carisella | E21B 33/1216 166/134 |
| 6,446,717 | B1 | 9/2002 | White et al. | |
| 6,598,672 | B2 * | 7/2003 | Bell | E21B 33/1216 166/134 |
| 6,962,206 | B2 | 11/2005 | Hirth et al. | |
| 7,165,622 | B2 | 1/2007 | Hirth et al. | |
| 10,822,911 | B2 | 11/2020 | Hrupp | |
| 11,473,393 | B2 * | 10/2022 | Dallas | E21B 33/1208 |
| 2009/0242215 | A1 * | 10/2009 | Eatwell | E21B 33/128 166/387 |
| 2012/0090858 | A1 * | 4/2012 | Ingram | E21B 33/128 166/147 |
| 2014/0305627 | A1 | 10/2014 | Manke | |
| 2021/0071496 | A1 * | 3/2021 | Brown | E21B 33/1216 |
| 2021/0131219 | A1 * | 5/2021 | Brown | F16J 15/3284 |

* cited by examiner

*Primary Examiner* — Theodore N Yao
(74) *Attorney, Agent, or Firm* — JK Intellectual Property Law, PA

(57) ABSTRACT

A wear-resistant annular seal assembly has a plurality of interlocking one-piece seal segments interleaved with a plurality of two-piece seal segments. The seal segments are made using wear-resistant rigid material such as steel, stainless steel or a composite material. In one embodiment the seal segments are coated with a fluoropolymer. A straddle packer includes a first and second spaced apart ones of the wear-resistant seal assemblies and a linear force generator for urging the first and second seal assemblies to a seal-set condition.

19 Claims, 10 Drawing Sheets

WEAR-RESISTANT ANNULAR SEAL ASSEMBLY AND STRADDLE PACKER INCORPORATING SAME

CROSS REFERENCE TO RELATED APPLICATIONS

This is a continuation-in-part of U.S. patent application Ser. No. 17/179,593 filed Feb. 19, 2021.

FIELD OF THE INVENTION

This invention relates in general to sealing systems for isolating fluids in cased hydrocarbon well bores and more precisely to a wear-resistant annular seal assembly and straddle packer incorporating same.

BACKGROUND OF THE INVENTION

Fluid isolation in cased well bores using various seal assemblies is well known in the art. In general, such seal assemblies are single-set metal seals or resettable elastomeric sealing elements, such as the packer elements used on straddle packers, and the like.

It is also well understood that the rate of hydrocarbon production from oil and gas wells decreases over time, and that production from such wells can often be extended if production stimulation fluids are injected into the producing formation surrounding the well bore. However, to be optimally effective those production stimulation fluids must be sequentially injected under pressure into isolated sections of the well bore to ensure an even and thorough penetration of the entire producing formation.

Traditional straddle packers are used to pressure isolate sections a cased hydrocarbon well bore. Those straddle packers are equipped with spaced-apart elastomeric packer elements that are expanded to seal against the well casing to contain injected fluid pressure within the section of the well bore isolated by the straddle packer. Straddle packers with elastomeric packer elements generally isolate fluid pressure quite effectively, but they suffer from certain operational disadvantages in perforated casings of well bores that need to be recompleted to restart or prolong hydrocarbon production. Most importantly, the elastomeric packer elements must fit closely within the casing in a relaxed or run-in condition to pack-off effectively to contain elevated fluid pressures. This makes the elastomeric packer elements vulnerable to wear and damage if the cased well bore has been previously perforated for hydrocarbon production, because casing burrs or formation intrusions into the perforated casing can cut and/or tear the elastomeric packer elements as they are displaced within the cased well bore. Regardless, the elastomeric packer elements are subject to material fatigue due to the extreme pressure stresses of containing high-pressure stimulation fluids, and they must be replaced on a regular basis. Pulling a straddle packer from a well bore and disassembling the straddle packer to replace spent elastomeric packer elements is very time consuming, especially when recompleting a long lateral well bore, which may require many packer element replacements.

Consequently, long lateral well bores are frequently recompleted by setting a fixed packer at a heel of the well bore and pumping stimulation fluid into the entire well bore at once. As understood by those skilled in the art, this unfocused production stimulation process does not permit any control of fluid or proppant placement within the producing formation and therefore provides no guarantee of optimal recompletion or subsequent production from the well bore.

There therefore exists a need for wear-resistant annular seal assemblies and straddle packers incorporating same which can be more easily moved within a perforated casing and provide an extended service cycle for recompeting long lateral well bores in a single downhole run into the well casing.

SUMMARY OF THE INVENTION

It is therefore an object of the invention to provide a wear-resistant annular seal assembly and straddle packers that incorporate those seal assemblies.

The invention therefore provides a wear-resistant annular seal assembly comprising a plurality of interlocking seal segments supported on one end by an active segment cone and on an opposite end by the reactive segment cone, the active segment cone being connected to an active seal mandrel and the reactive segment cone being connected to a reactive seal mandrel, the interlocking seal segments being adapted to radially expand from a run-in condition to a seal-set condition when an axial force acting on the active seal mandrel urges the active segment cone towards the reactive segment cone.

The invention further provides a wear-resistant annular seal assembly, comprising: an inner mandrel adapted to support an active seal mandrel and a reactive seal mandrel; an active segment cone connected to an end of the active seal mandrel and a reactive segment cone connected to an end of the reactive seal mandrel; an active seal sleeve adapted to reciprocate on the active seal mandrel and a reactive seal sleeve adapted to reciprocate on the reactive seal mandrel; a plurality of interlocking seal segments supported on one end by the active segment cone and on an opposite end by the reactive segment cone, the one end being retained on the active segment cone by the active seal sleeve and the opposite end being retained on the reactive segment cone by the reactive seal sleeve; a reactive coil spring that constantly urges the reactive seal sleeve to move the interlocking seal segments to a run-in condition; and a segment underseal adapted to expand upwardly to contact a bottom surface of the interlocking seal segments when the interlocking seal segments are urged to a seal-set condition.

The invention yet further provides a straddle packer comprising first and second spaced-apart wear-resistant annular seal assemblies that comprise a plurality of interlocking seal segments adapted to be supported on one end by an active segment cone and on an opposite end by the reactive segment cone, the one end being retained on the active segment cone by an active seal sleeve and the opposite end being retained on the reactive segment cone by a reactive seal sleeve, the interlocking seal segments being adapted to radially expand from a run-in condition to a seal-set condition when an axial force urges the active segment cone towards the reactive segment cone.

BRIEF DESCRIPTION OF THE DRAWINGS

Having thus generally described the nature of the invention, reference will now be made to the accompanying drawings, in which.

DETAILED DESCRIPTION OF THE PREFERRED EMBODIMENTS

Figure 1:
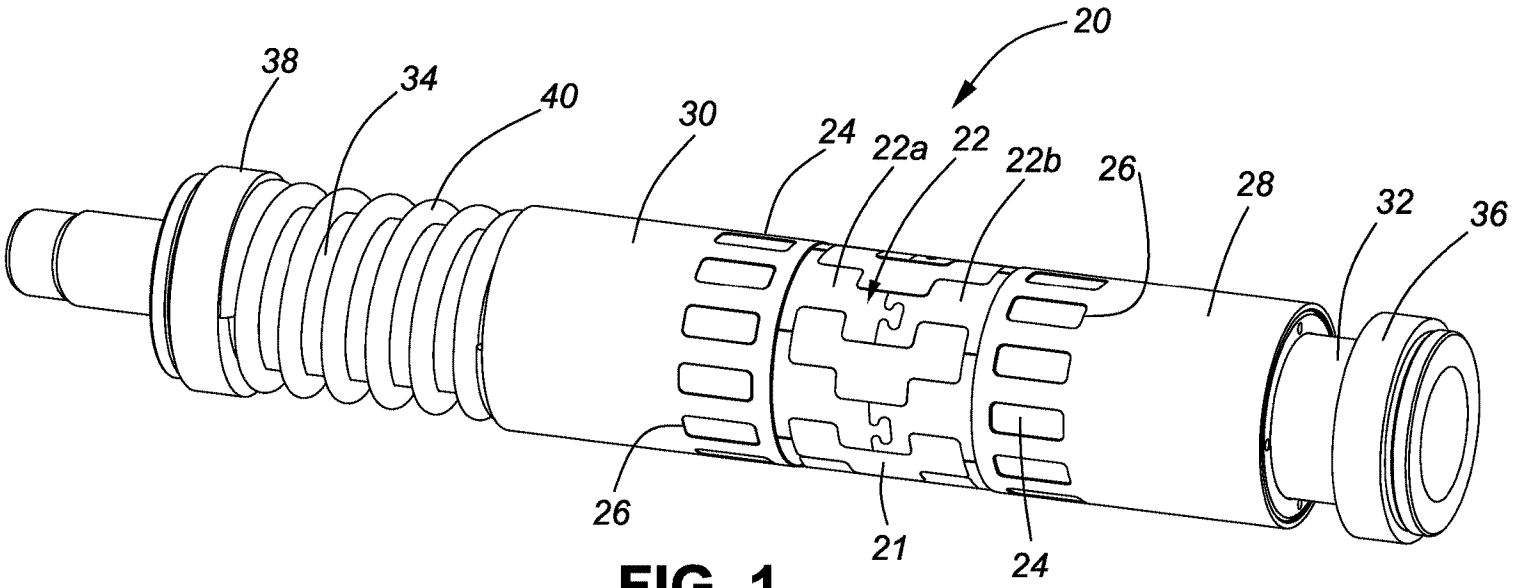
FIG. 1 is a perspective view of one embodiment of a wear-resistant annular seal assembly in accordance with the invention in an unexpanded or run-in condition.

The invention provides wear-resistant annular seal assemblies for use in isolating fluid pressure within a cased well bore, and straddle packers incorporating the seal assemblies. In one embodiment, the wear-resistant annular seal assembly has a segmented seal that is radially expandable from a run-in to a seal-set condition in which interlocking seal segments of the segmented seal assembly contact a well casing in which the seal assembly is set. The interlocking seal segments are constructed using a rigid, wear-resistant material such as, for example, steel, stainless steel or composite material, any one of which may be coated with a heat and wear-resistant coating, such as a fluoropolymer or the like. In the run-in condition the wear-resistant annular seal assembly has a smaller outer diameter than a prior art elastomeric seal element for a corresponding size of well casing. This facilitates tool run-in in highly deviated well bores and long lateral well bores.

In one embodiment, the wear-resistant seal assembly has a plurality of identical single-part seal segments interleaved with a plurality of two-part seal segments. Each seal segment has a segment stabilizer lug on each end. The respective segment stabilizer lugs are captured in respective spaced-apart stabilizer lug slots in an active seal sleeve and a reactive seal sleeve of the wear-resistant seal assembly. The active seal sleeve reciprocates on an active seal mandrel and the reactive seal sleeve reciprocates on a reactive seal mandrel of the wear-resistant seal assembly. A free end of the active seal mandrel supports an active connecting member, and a free end of the reactive seal mandrel supports a reactive connecting member. A reactive coil spring in captured on the reactive seal mandrel between the reactive seal sleeve and the reactive connecting member. The reactive coil spring constantly urges the wear-resistant seal assembly to the run-in condition. An active segment cone is affixed to an inner end of the active seal mandrel and a reactive segment cone is affixed to an inner end of the reactive seal mandrel. Opposed ends of the seal segments are inclined at a same angle as the respective segment cones and are respectively supported by the respective segment cones.

A segment underseal is supported between the active segment cone and the reactive segment cone on a seal assembly inner mandrel. In one embodiment, the segment underseal is an elastomeric tubular sleeve. Axial compressive force applied to the active connecting member urges the active segment cone towards the reactive segment cone, which compresses the segment underseal and urges radial movement of the interlocking seal segments to the seal-set condition in which top surfaces of the interlocking seal segments contact an inner surface of the well casing and the elastomeric underseal expands radially into sealing engagement with a bottom surface of the respective interlocking seal segments in a high-pressure fluid resistant seal. When the axial compressive force is released, the reactive coil spring urges the wear-resistant seal assembly to return to the run-in condition and the segment underseal to relax. In one embodiment, a leveling spring, which is a coil compression spring, is captured between a first end of each seal segment and the active seal sleeve, and a second end of each seal segment and the reactive seal sleeve to further assist in returning the wear-resistant seal assembly to the run-in condition.

| Part No. | Part Description |
|---|---|
| 20 | Wear-resistant annular seal assembly |
| 20a | Uphole seal assembly |
| 20b | Downhole seal assembly |
| 21 | One-part seal segments |
| 22 | Two-part seal segments |
| 22a | Two-part segment male end |

-continued

| Part No. | Part Description |
|---|---|
| 22b | Two-part segment female end |
| 24 | Segment stabilizer lugs |
| 26 | Stabilizer lug slots |
| 27 | Segment underseal |
| 28 | Active seal sleeve |
| 30 | Reactive seal sleeve |
| 32 | Active seal mandrel |
| 33 | Reactive underseal sleeve |
| 34 | Reactive seal mandrel |
| 35 | Seal assembly inner mandrel |
| 36 | Active connecting member |
| 38 | Reactive connecting member |
| 40 | Reactive coil spring |
| 42 | Active segment cone |
| 44 | Reactive segment cone |
| 46 | Leveling springs |
| 48 | Active sleeve end cap |
| 50 | Reactive sleeve end cap |
| 52 | Active cone O-ring |
| 54 | Reactive cone O-ring |
| 56 | Well casing |
| 58 | Segment main body portion |
| 60 | Segment offset |
| 62 | Segment offset notch |
| 64 | Leveling spring notch |
| 66 | Leveling spring socket |
| 68 | Segment active incline |
| 70 | Segment reactive incline |
| 72 | Segment top surface |
| 74 | Segment bottom surface |
| 75 | Flow path obstructors |
| 76 | Two-part dovetail joint |
| 78a | Dovetail male component |
| 78b | Dovetail female socket |
| 80 | Straddle packer |
| 82 | Work string connection |
| 83 | Push ring |
| 84 | Sliding sleeve section |
| 86 | Injector sub |
| 88 | Injector nozzles |
| 90 | Linear force generator |
| 92 | Transition sleeve |
| 94 | Velocity bypass sub |
| 96 | End cap |
| 98 | Multicomponent mandrel |
| 99 | Central passage |
| 100 | Uphole seal assembly support component |
| 101 | Upper crossover sleeve |
| 102 | Upper mandrel tube |
| 104 | Lower mandrel tube |
| 106 | Upper sliding sleeve |
| 108 | Slotted sliding sleeve |
| 110 | Slotted sliding sleeve finger components |
| 112 | Lower sliding sleeve |
| 113 | Sliding sleeve crossover |
| 114 | Force generator piston support component |
| 116 | Force generator piston sleeve |
| 120 | Piston sleeve end cap |
| 122 | Mandrel crossover adapter |
| 123 | Force generator piston |
| 124 | Force generator piston component ports |
| 126 | Force generator piston ports |
| 128 | Force generator piston chamber |
| 130 | Force generator return spring |
| 132 | Velocity bypass valve |
| 134 | Velocity bypass valve spring |
| 136 | Velocity bypass valve ports |
| 138 | Velocity bypass valve orifice |

FIG. 1 is a perspective view of one embodiment of a wear-resistant seal assembly 20 (hereinafter simply "seal assembly 20") in accordance with the invention in a run-in condition used to run the seal assembly 20 into a cased well bore or to move the seal assembly 20 within the cased well bore. The seal assembly 20 has a plurality of interleaved, interlocking seal segments 21, 22, the shape and configuration of which will be explained in detail below with reference to FIGS. 7A-7O. In one embodiment, the seal segments 22 are two-part segments having a two-part segment male end 22*a* and a two-part segment female end 22*b*. Each seal segment 21, 22 has a segment stabilizer lug 24 on each end thereof. In one embodiment, the segment stabilizer lugs 24 have a rounded rectangle shape in top plan view, and they are respectively received in correspondingly-shaped stabilizer lug slots 26 in an active seal sleeve 28 and a reactive seal sleeve 30 disposed on opposite sides of the interleaved, interlocking seal segments 21, 22. The segment stabilizer lugs 24 and the stabilizer lug slots 26 ensure that the respective interlocking seal segments 21, 22 remain in parallel alignment as they are shifted from the run-in condition to a seal-set condition explained below with reference to FIGS. 3 and 4. As understood by any person skilled in the art, the segment stabilizer lugs 24 and the corresponding stabilizer lug slots 26 may be any shape that will retain the interlocking seal segments 21, 22 in parallel alignment as the seal assembly 20 is shifted from the run-in condition shown in FIG. 1 to the seal-set condition, and vice versa.

The active seal sleeve 28 reciprocates on an active seal mandrel 32, and the reactive seal sleeve 30 reciprocates on a reactive seal mandrel 34. A free end of the active seal mandrel 32 terminates in an active connecting member 36, a configuration of which is a matter of design choice and dependent on a type of tool in which the seal assembly 20 is incorporated. A free end of the reactive seal mandrel 34 terminates in a reactive connecting member 38, the configuration of which is likewise a matter of design choice. Supported on the reactive seal mandrel 34 between the reactive seal sleeve 30 and the reactive connecting member 38 is a reactive coil spring 40. In one embodiment, the reactive coil spring 40 is installed under a preload compression of about 2,000 pounds (909 kilos), which constantly urges the seal assembly 20 to the run-in condition.

Figure 2:
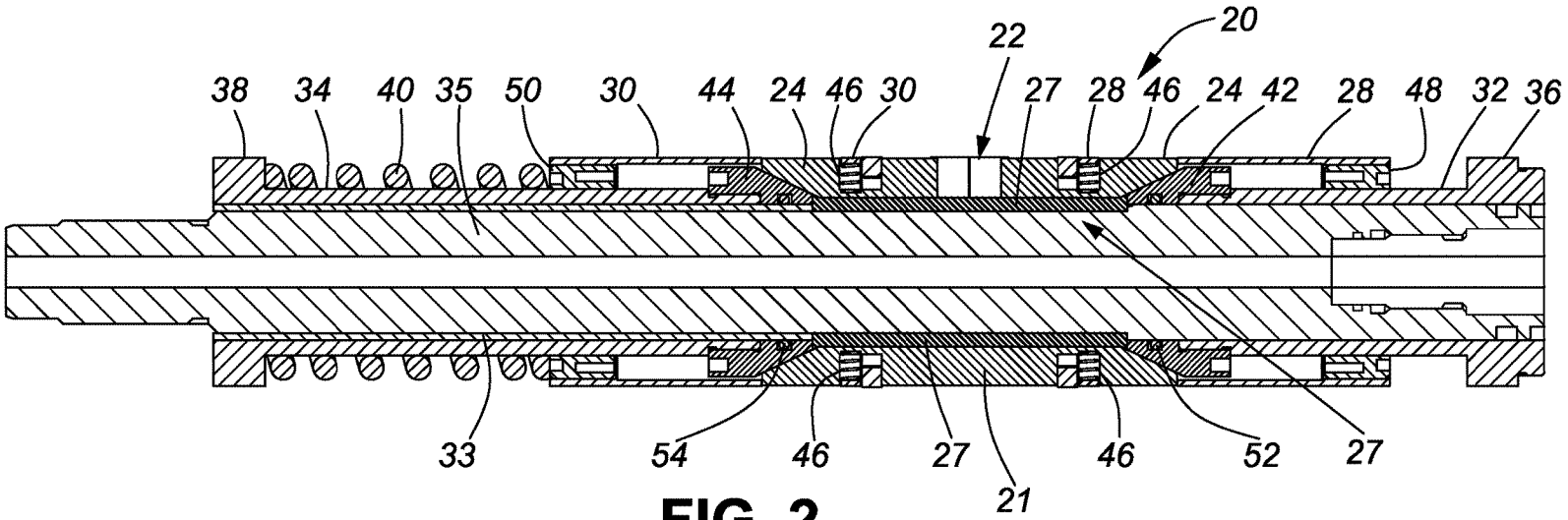
FIG. 2 is a cross-sectional view of the wear-resistant annular seal assembly shown in FIG. 1.

FIG. 2 is a cross-sectional view of the seal assembly 20 in the run-in condition shown in FIG. 1. As can be seen, one end of the respective interlocking seal segments 21, 22 is supported on an active segment cone 42 that is affixed to an inner end of the active seal mandrel 32, for example, by a threaded connection. The opposite end of the respective interlocking seal segments 21, 22 is supported on a reactive segment cone 44 that is affixed to an inner end of the reactive seal mandrel 34, for example, by a threaded connection. In one embodiment, leveling springs 46 are captured within leveling spring sockets on opposed ends of the respective interlocking seal segments 21, 22. A top end of the respective leveling springs 46 is retained by the active seal sleeve 28 on one end of each seal segment 21, 22, and the reactive seal sleeve 30 on the opposite end of each seal segment 21, 22. The leveling springs 46 are inserted with pre-load compression and assist the reactive coil spring 40 in returning the seal assembly 20 to the run-in condition and maintaining the seal assembly 20 in the run-in condition. The reactive coil spring 40 and the leveling springs 46 further function to keep the seal segments 21, 22 in the run-in condition if an obstruction is "tagged" in a cased well bore while running the seal assembly 20 into the cased well bore or relocating it within the cased well bore. The leveling springs 46 yet further function to ensure that the respective seal segments 21, 22 remain in axial alignment with the active seal sleeve 28 and the reactive seal sleeve 30.

An active sleeve end cap 48 is threadedly connected to an inner end of the active seal sleeve 28. The active sleeve end cap 48 reciprocates with the active seal sleeve 28 on the active seal mandrel 32. A reactive sleeve end cap 50 is threadedly connected to an inner end of the reactive seal sleeve 30. The reactive sleeve end cap 50 reciprocates with the reactive seal sleeve 30 on the reactive seal mandrel 34. The active sleeve end cap 48 and the reactive sleeve end cap 50 respectively stabilize the respective free ends of the active seal sleeve 28 and the reactive seal sleeve 30. An active cone O-ring 52 provides a fluid-resistant seal between the active segment cone 42 and the seal assembly inner mandrel 35. A reactive cone O-ring 54 provides a fluid-resistant seal between the reactive segment cone 44 and the seal assembly inner mandrel 35.

A segment underseal 27 cooperates with the seal segments 21, 22 to inhibit fluid flow through the seal assembly 20 as will be explained below with reference to FIG. 4. In one embodiment, the segment underseal 27 is a tubular sleeve made of elastomeric material. The segment underseal 27 may molded or cast using any heat, fatigue and wear resistant elastic polymer or polymer blend, such as a fluoropolymer for example. In one embodiment, the segment underseal 27 is made of HNBR (Hydrogenated Nitrile Butadiene Rubber). A rigid reactive underseal sleeve 33 facilitates insertion of the segment underseal 27 during assembly of the wear-resistant annular seal assembly 20.

Figure 3:
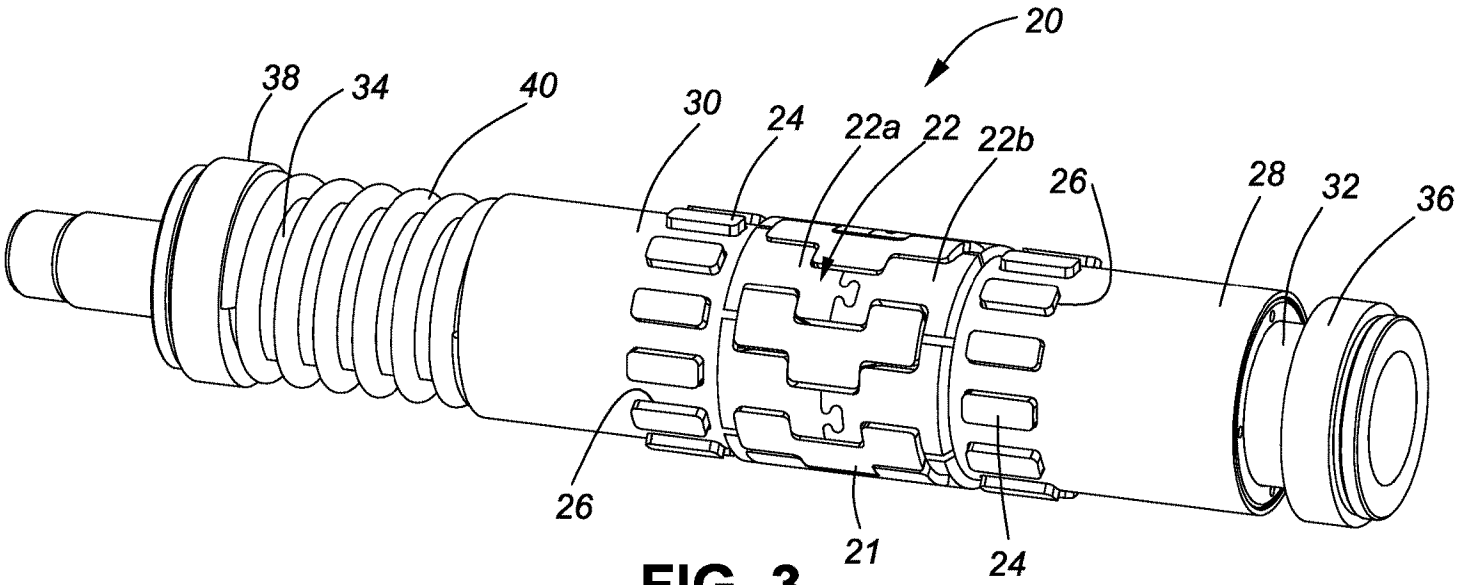
FIG. 3 is a perspective view of the wear-resistant annular seal assembly shown in FIG. 1 in an expanded or seal-set condition.

FIG. 3 is a perspective view of the seal assembly 20 shown in FIG. 1 in an expanded or seal-set condition. In the seal set condition, the interlocking seal segments 21, 22 are forced radially outwardly into contact with a well casing 56 (see FIG. 6), and the segment stabilizer lugs 24 are forced radially outwardly through the respective stabilizer lug slots 26. As explained above, the segment stabilizer lugs 24 ensure that the seal segments 21, 22 remain parallel and equally spaced-apart as the seal assembly 20 is expanded to the seal-set condition by forced movement of the active seal mandrel 32 towards the reactive seal mandrel 34, while the respective leveling springs 46 ensure that the respective interlocking seal segments 21, 22 remain in axial alignment with the respective seal mandrels 32, 34.

Figure 4:
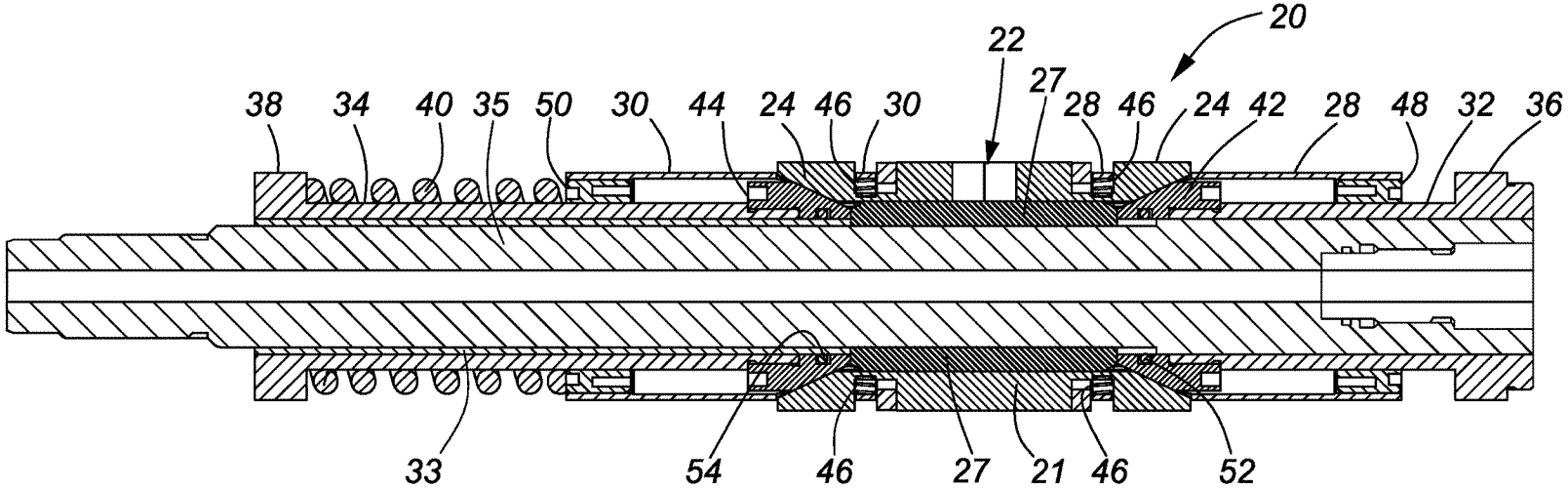
FIG. 4 is a cross-sectional view of the wear-resistant annular seal assembly shown in FIG. 3.

FIG. 4 is a cross-sectional view of the downhole seal assembly 20 shown in FIG. 3. When linear force adequate to overcome a bias of the reactive coil spring 40 and the leveling springs 46 is applied to the active connecting member 36, that force urges the active segment cone 42 to move towards the reactive segment cone 44. As the respective interlocking seal segments 21, 22 are urged upwardly on the active segment cone 42 and the reactive segment cone 44, the segment stabilizer lugs 24 urge the active seal sleeve 28 towards the active connecting member 36 and the reactive seal sleeve 30 towards the reactive connecting member 38. In the seal-set condition, the reactive coil spring 40 is compressed by movement of the reactive seal sleeve 30 over the reactive seal mandrel 34, and the respective leveling springs 46 are compressed against a respective one of the active seal sleeve 28 and the reactive seal sleeve 30. As the active segment cone 42 is urged toward the reactive segment cone 44, the segment underseal 27 is compressed and radially expands into sealing contact with a bottom surface of the respective seal segments 21, 22, inhibiting fluid flow through the seal assembly, as will be explained below in more detail. When the linear force is no longer applied to the active connecting member 36, the leveling springs 46, the reactive coil spring 40 and the segment underseal 27 urge the seal assembly 20 to return the respective interlocking seal segments 21, 22 to the run-in condition shown in FIGS. 1 and 2, to permit the seal assembly 20 to be moved to a new location within a well casing 56 (see FIG. 6) or recovered from the well casing 56.

Figure 5:
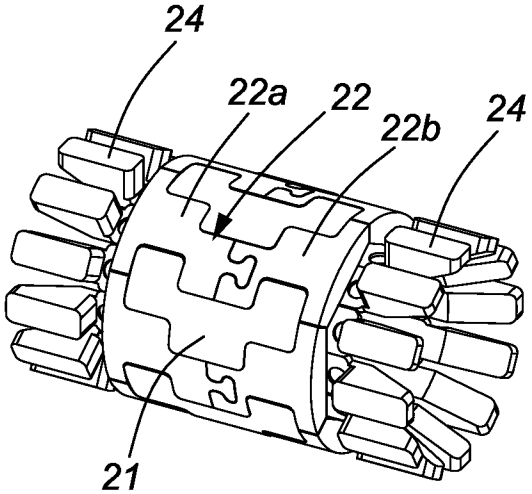
FIG. 5 is a perspective view of seal segments of the wear-resistant annular seal assembly shown in the run-in condition.

FIG. 5 is a perspective view of the interlocking seal segments 21, 22 of the seal assembly 20 shown in FIG. 1 in the run-in condition. In one embodiment the interlocking seal segments 21, 22 are made using a wear-resistant rigid material such as steel, stainless steel or a composite material. As can be seen, in the run-in condition the respective seal segments 21, 22 interlock and fit very closely together. In one embodiment, a gap between the respective interlocking seal segments 21, 22 is 0.001"-0.002" (25-50 microns).

Figure 6:
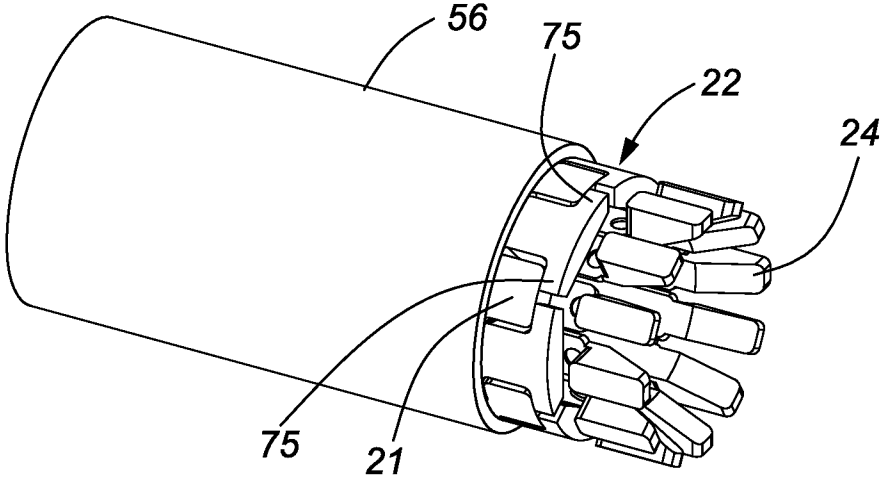
FIG. 6 is a perspective view of the seal segments shown in the seal-set condition partially within a well casing.

FIG. 6 is a perspective view of the interlocking seal segments 21, 22 shown in FIG. 3 in the seal-set condition within the well casing 56. In the seal-set condition, the respective interlocking seal segments 21, 22 are urged radially outward into contact with the well casing 56 and the respective interlocking seal segments 21, 22 are slightly spaced-apart. However, as will be explained below with reference to FIGS. 7A-7O, a main body portion 58 of each seal segment 21, 22 includes a segment offset 60 (see FIGS. 7A-7G) that fits closely within a segment offset notch 62 of an adjacent seal segment 21, 22. When subjected to fluid pressure, the segment offset 60 is urged against an unpressurized side of the segment offset notch 62 of the adjacent seal segment 21, 22 to provide a fluid seal that inhibits fluid migration between the respective interlocking seal segments 21, 22 in the seal-set condition. In addition, flow path obstructors 75 on opposite sides of each end of the seal segments 22 obstruct the gap between respective interlocking seal segments 21 and 22 to further reduce any flow path through the seal assembly 20. As explained above with reference to FIG. 4, the segment underseal 27 also presses against a bottom surface of each interlocking seal segment 21, 22 to obstruct flow through any gap and under the respective interlocking seal segments 21, 22.

Figure 7D:
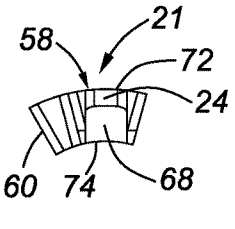
FIG. 7D is an end view of the single-part seal segment shown in FIG. 7A.
Figure 7B:
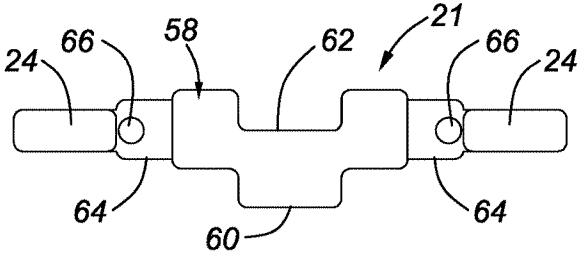
FIG. 7B is a top plan view of the single-part seal segment shown in FIG. 7A.
Figure 7C:
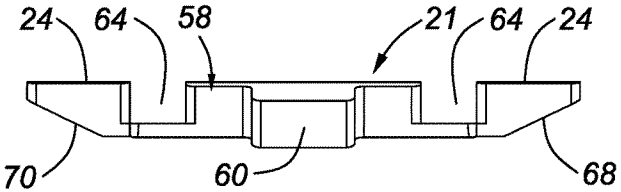
FIG. 7C is a side elevational view of the single-part seal segment shown in FIG. 7A.
Figure 7H:
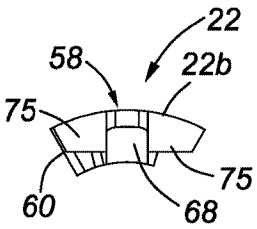
FIG. 7H is an end view of the two-part seal segment shown in FIG. 7E.
Figure 7F:
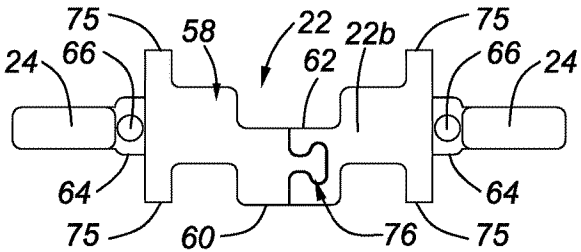
FIG. 7F is a top plan view of the two-part seal segment shown in FIG. 7E.
Figure 7G:
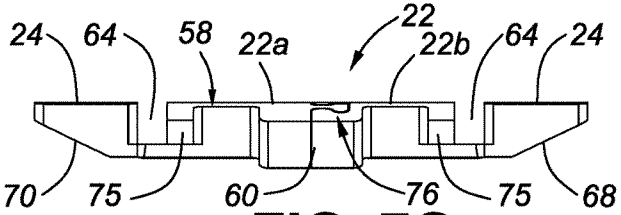
FIG. 7G is a side elevational view of the two-part seal segment shown in FIG. 7E.
Figure 7A:
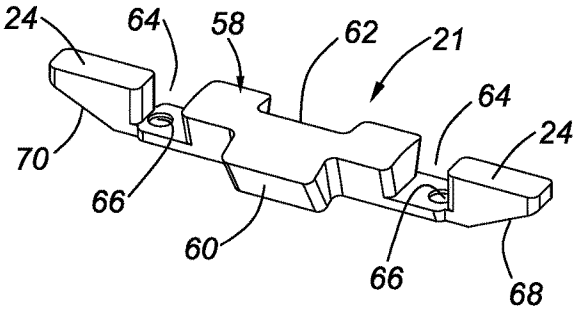
FIG. 7A is a perspective view of a single-part seal segment in accordance with one embodiment of the invention.

FIG. 7A is a perspective view of a seal segment 21 in accordance with one embodiment of the invention. FIG. 7B is a top plan view of a seal segment 21 shown in FIG. 7A. FIG. 7C is a side elevational view of a seal segment 21 shown in FIG. 7A. FIG. 7D is an end view of the seal segment 21 shown in FIG. 7A. Each seal segment 21 has a main body portion 58 having a longitudinal axis. The main body portion 58 has the segment offset 60 that is offset from the longitudinal axis of the main body portion 58 and the corresponding segment offset notch 62 that receives the segment offset 60 of an adjacent seal segment 22, as explained above with reference to FIG. 6. At each end of the main body portion 58 there is a leveling spring notch 64 with a leveling spring socket 66 in a bottom surface of the leveling spring notch 64. As can be seen, a bottom surface of an outer end of each segment stabilizer lug 24 is inclined at an angle of an outer surface of the respective segment cones 42, 44. The active end of each seal segment 21 has a segment active incline 68 and the reactive end of each seal segment 21 has a segment reactive incline 70, which is equal and opposite to the segment active incline 68. A segment top surface 72 (FIG. 7D) and segment bottom surface 74 of each seal segment 21 is a circular arc, the radius of the circular arc of the top surface 72 is determined by a diameter of the well casing 56 in which the seal assembly 20 is to be used, as understood by those skilled in the art.

Figure 7E:
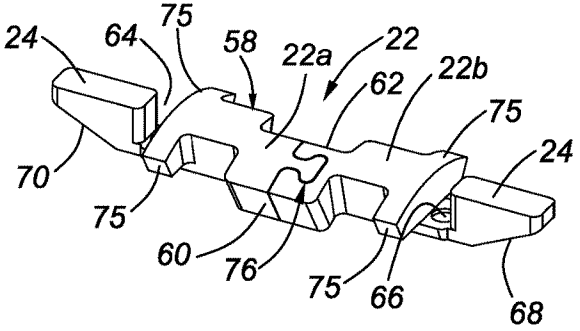
FIG. 7E is a perspective view of a two-part seal segment in accordance with one embodiment of the invention.

FIG. 7E is a perspective view of the two-part seal segment 22 in accordance with one embodiment of the invention. FIG. 7F is a top plan view of the two-part seal segment 22 shown in FIG. 7E. FIG. 7G is a side elevational view of the two-part seal segment 22 shown in FIG. 7E. FIG. 7H is an end view of the two-part seal segment 22 shown in FIG. 7E. As can be seen, the two-part seal segment 22 is quite similar to the one-part seal segment 21, except that the two-part seal segment 22 is longer than the one-part seal segment 21 and includes the laterally extending flow path obstructors 75 on each side of each end of the main body portion 58. The two-part seal segment 22 further includes a dovetail joint 76 in a middle of the segment offset 60, as will be explained below in more detail with reference to FIGS. 7I-7O.

Figure 7L:
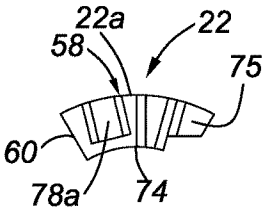
FIG. 7L is an end view of the male portion shown in FIG. 7I.
Figure 7P:
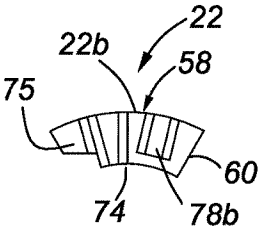
FIG. 7P is an end view of the female portion shown in FIG. 7M.
Figure 7J:
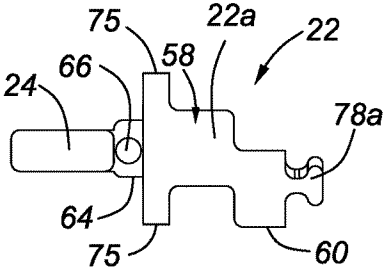
FIG. 7J is a top plan view of the male portion shown in FIG. 7I.
Figure 7K:
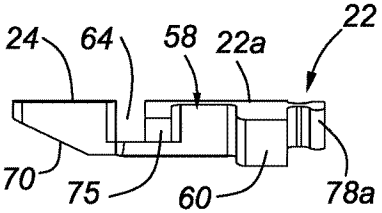
FIG. 7K is a side elevational view of the male portion shown in FIG. 7I.
Figure 7N:
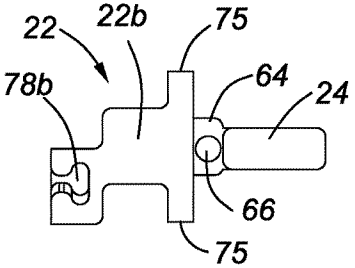
FIG. 7N is a top plan view of the female portion shown in FIG. 7M.
Figure 7O:
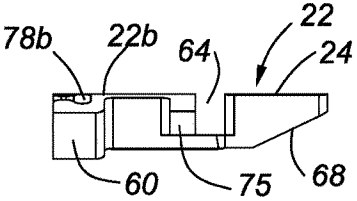
FIG. 7O is a side elevational view of the female portion shown in FIG. 7M.
Figure 7I:
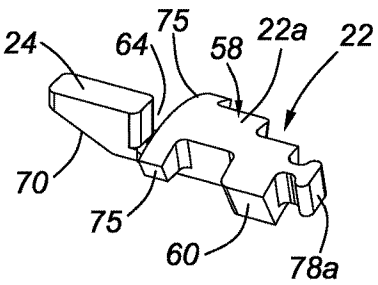
FIG. 7I is a perspective view of a male portion of the two-part seal segment shown in FIG. 7E.
Figure 7M:
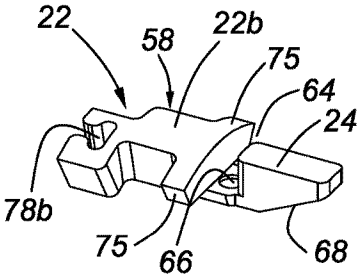
FIG. 7M is a perspective view of a female portion of the two-part seal segment shown in FIG. 7E.

FIG. 7I is a perspective view of a male portion 22*a* of the two-part seal segment 22 shown in FIG. 7E. FIG. 7J is a top plan view of the male portion 22*a* shown in FIG. 7I. FIG. 7K is a side elevational view of the male portion 22*a* shown in FIG. 7I. FIG. 7L is an end view of the male portion 22*a* shown in FIG. 7I. FIG. 7M is a perspective view of a female portion 22*b* of the two-part seal segment 22 shown in FIG. 7. FIG. 7N is a top plan view of the female portion 22*b* shown in FIG. 7M. FIG. 7O is a side elevational view of the female portion 22*b* shown in FIG. 7M. FIG. 7P is an end view of the female portion 22*b* shown in FIG. 7M. In one embodiment, a dovetail male component 78*a* of the two-part dovetail joint 76 is machined to fit within a dovetail female socket 78*b* of the two-part dovetail joint 76 in a "loose connection", with a tolerance of 0.012"-0.020" (300-500 microns). The loose connection ensures that the flow path obstructors 75 of two-part seal segments 22 are forced into sealing contact with and end of the seal segments 21 on a pressurized side of the seal assembly 20 when the seal assembly 20 is moved to the seal-set condition and subjected to an unbalanced high fluid pressure.

Figure 7Q:
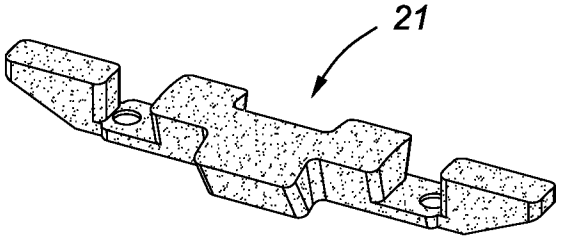
FIG. 7Q is an alternate embodiment of the single-part seal segment shown in FIG. 7A.
Figure 7R:
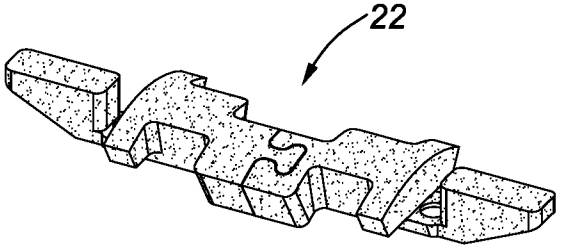
FIG. 7R is an alternate embodiment of the two-part seal segment shown in FIG. 7E.

FIG. 7Q is an alternate embodiment of the single-part seal segment shown in FIG. 7A. In one embodiment the seal segments 21 are coated with a thin coating (for example about 0.10", 250 microns) of a wear-resistant and heat-resistant coating, for example a fluoropolymer, to improve a fluid seal with the well casing and improve the fluid seal between the respective interlocking seal segments 21, 22 in the seal-set condition, and to reduce friction between the respective interlocking seal segments 21, 22 as they are urged from the run-in to the seal-set condition and vice versa. The coating also protects certain metal seal segments 21, 22 from corrosion in "sour service' applications. FIG. 7R is an embodiment of the two-part seal segment 22 shown in FIG. 7E with the protective coating. Examples of fluoropolymers suitable for coating the seal segments 21, 22 include, but are not limited to, PTFE (polytetrafluoroethylene) and ECTFE (polyethylenechlorotrifluoroethylene).

Figure 8:
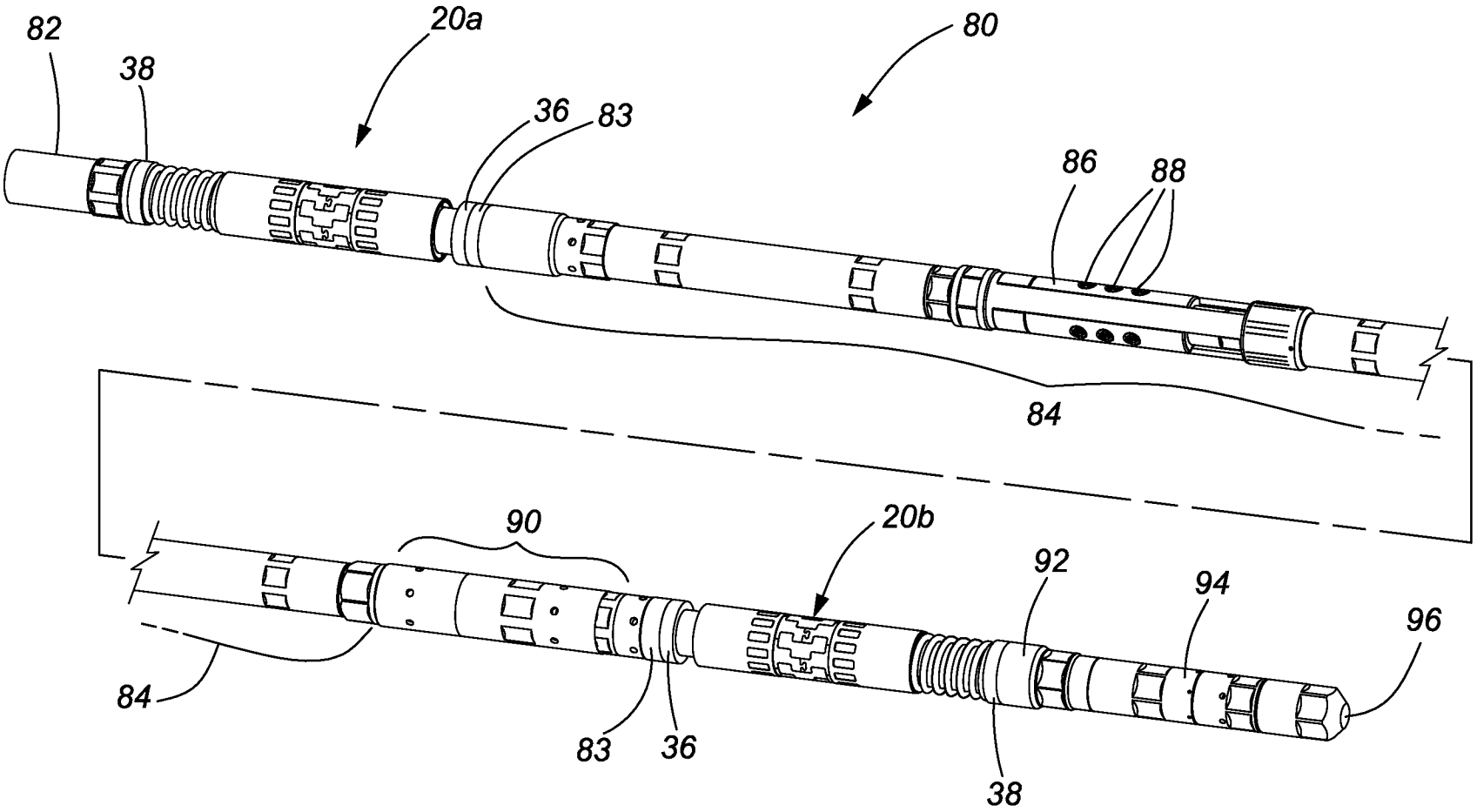
FIG. 8 is a perspective view of a straddle packer incorporating wear-resistant annular seal assemblies in accordance with one embodiment of the invention, in the run-in condition.

FIG. 8 is a perspective view of a straddle packer 80 incorporating seal assemblies 20*a*, 20*b* in accordance with the invention in the run-in condition. The straddle packer 80 has a work string connection 82 at an uphole end thereof. The work string connection 82 is configured for the connection of a work string, which may be a jointed tubing string or a coil tubing string, for example. The work string connection 82 is connected to the reactive connecting member 38 of the uphole seal assembly 20*a*. The active connecting member 36 of the uphole seal assembly 20*a* is connected to a push ring 83 that is connected to a sliding sleeve section 84, which will be explained below in more detail with reference to FIG. 9. The sliding sleeve section 84 exposes an injector sub 86, which is a component of a multicomponent mandrel 98 (see FIG. 9) of the straddle packer 80 which will also be explained in more detail below with reference to FIG. 9. A downhole end of the sliding sleeve section 84 is connected to a linear force generator 90, which converts pumped fluid pressure into a linear force required to move respective seal assemblies 20*a*, 20*b* to the seal set-condition shown in FIG. 10. One embodiment of the linear force generator 90 will also be described below with reference to FIG. 9. A downhole end of the linear force generator 90 is connected to a push ring 83 that is connected to the active connecting member 36 of the downhole seal assembly 20*b*. A reactive connecting member 38 of the downhole seal assembly 20*b* is connected to a transition sleeve 92 of the multicomponent mandrel 98. A downhole end of the transition sleeve 92 is connected to a velocity bypass sub 94, the function of which will be explained below. An end cap 96 is connected to a downhole end of the velocity bypass sub 94 and terminates the straddle packer 80.

Figure 9:
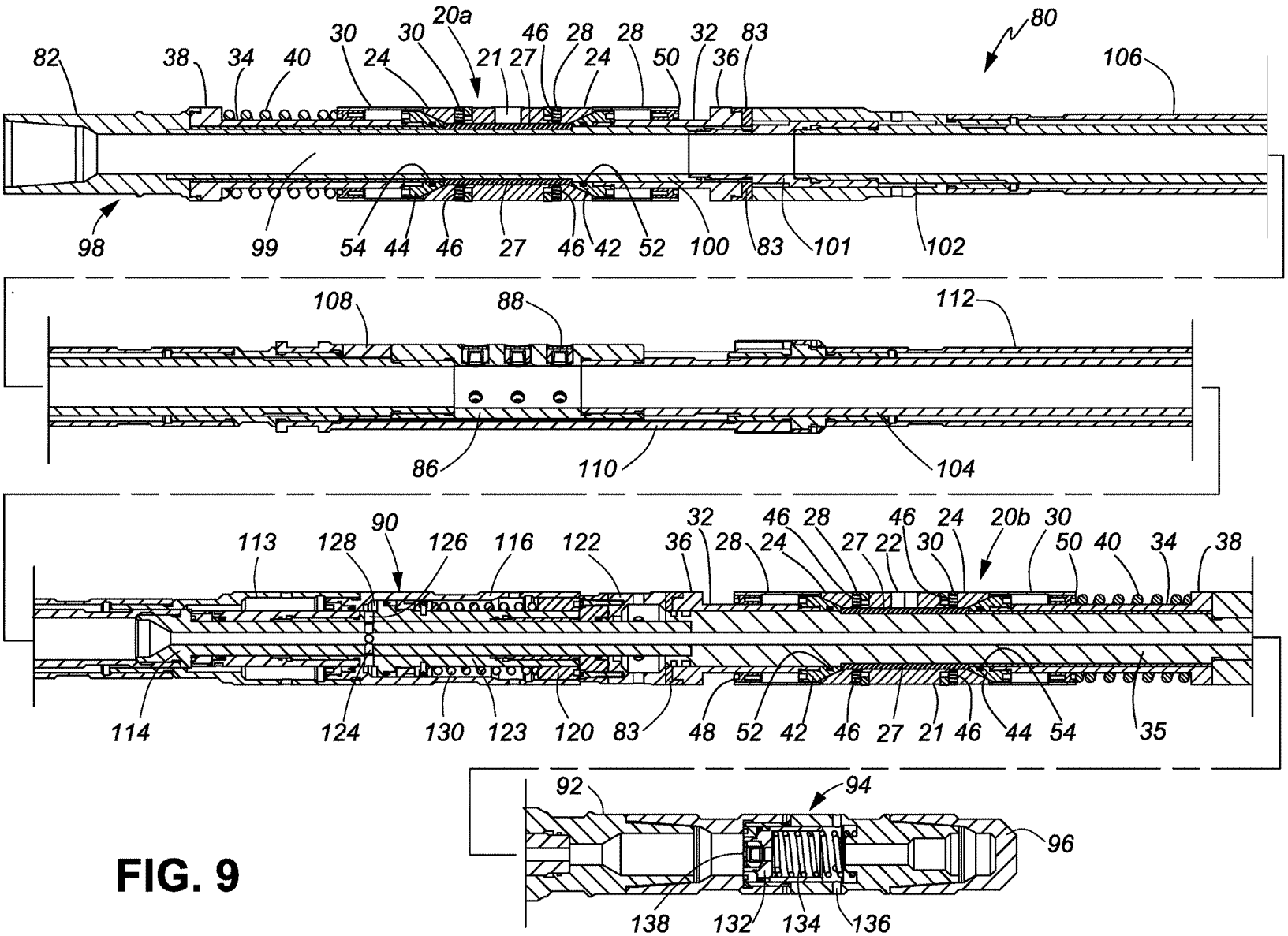
FIG. 9 is a cross-sectional view of the straddle packer shown in FIG. 8.

FIG. 9 is a cross-sectional view of one embodiment of the straddle packer 80 shown in FIG. 8. As explained above, the straddle packer 80 includes a multicomponent mandrel 98 having a central passage 99. In one embodiment, the multicomponent mandrel 98 includes the work string connection 82 which is threadedly connected to an uphole seal assembly support component 100, that is in turn connected to an upper crossover sleeve 101. An upper mandrel tube 102 is connected to the upper crossover sleeve 101 on the uphole end and the injector sub 86 on a downhole end. A lower mandrel tube 104 is connected to a downhole end of the injector sub 86. A force generator piston support component 114 of the multicomponent mandrel 98, having force generator piston component ports 124, the function of which will be explained below, is connected to a downhole end of the lower mandrel tube 104. The seal assembly inner mandrel 35 of the downhole seal assembly 20*b* is connected to a downhole end of the force generator piston support component 114. The transition sleeve 92 is connected to a downhole end of the seal assembly inner mandrel 35.

The sliding sleeve section 84 (FIG. 8) reciprocates within a limited range on the multicomponent mandrel 98. In one embodiment, the sliding sleeve section 84 includes an upper sliding sleeve 106 connected on an uphole end to the push ring 83 and on a downhole end to a slotted sliding sleeve 108 having slotted sliding sleeve finger components 110 that define slots which expose the injector nozzles 88 of the injector sub 86. A lower sliding sleeve 112 is connected to a downhole end of the slotted sliding sleeve finger components 110. A downhole end of the lower sliding sleeve 112 is connected to a sliding sleeve crossover 113 which is in turn connected to a force generator piston sleeve 116 that defines a piston chamber 128. A downhole end of the force generator piston sleeve 116 is supported by a piston sleeve end cap 120, which reciprocates on a force generator piston 123. The force generator piston 123 has force generator piston ports 126 in fluid communication with the force generator piston component ports 124 and the piston chamber 128. The force generator piston 123 reciprocates in the piston chamber 128 in response to pumped fluid pressure, as will be explained below with reference to FIG. 11. A force generator return spring 130 constantly urges the force generator piston towards an uphole end of the force generator piston chamber 128.

The force generation piston 123 is connected to a mandrel crossover adapter 122, which is connected to the push ring 83 that is connected to the active connecting member 36 of the downhole seal assembly 20*b*. The reactive connecting member 38 of the downhole seal assembly 20*b* is connected to the transition sleeve 92 of the multicomponent mandrel 98. The velocity bypass sub 94 has a velocity bypass valve 132 constantly urged to an open position by a velocity bypass valve spring 134. The velocity bypass valve 132 has a velocity bypass valve orifice 138 in fluid communication with the central passage 99. When the velocity bypass valve 132 is in the open position, the velocity bypass valve orifice 138 is also in fluid communication with velocity bypass valve ports 136, which permit fluid pumped into the central passage 99 to flow through the velocity bypass valve ports 136, as will be explained below with reference to FIG. 11.

Figure 10:
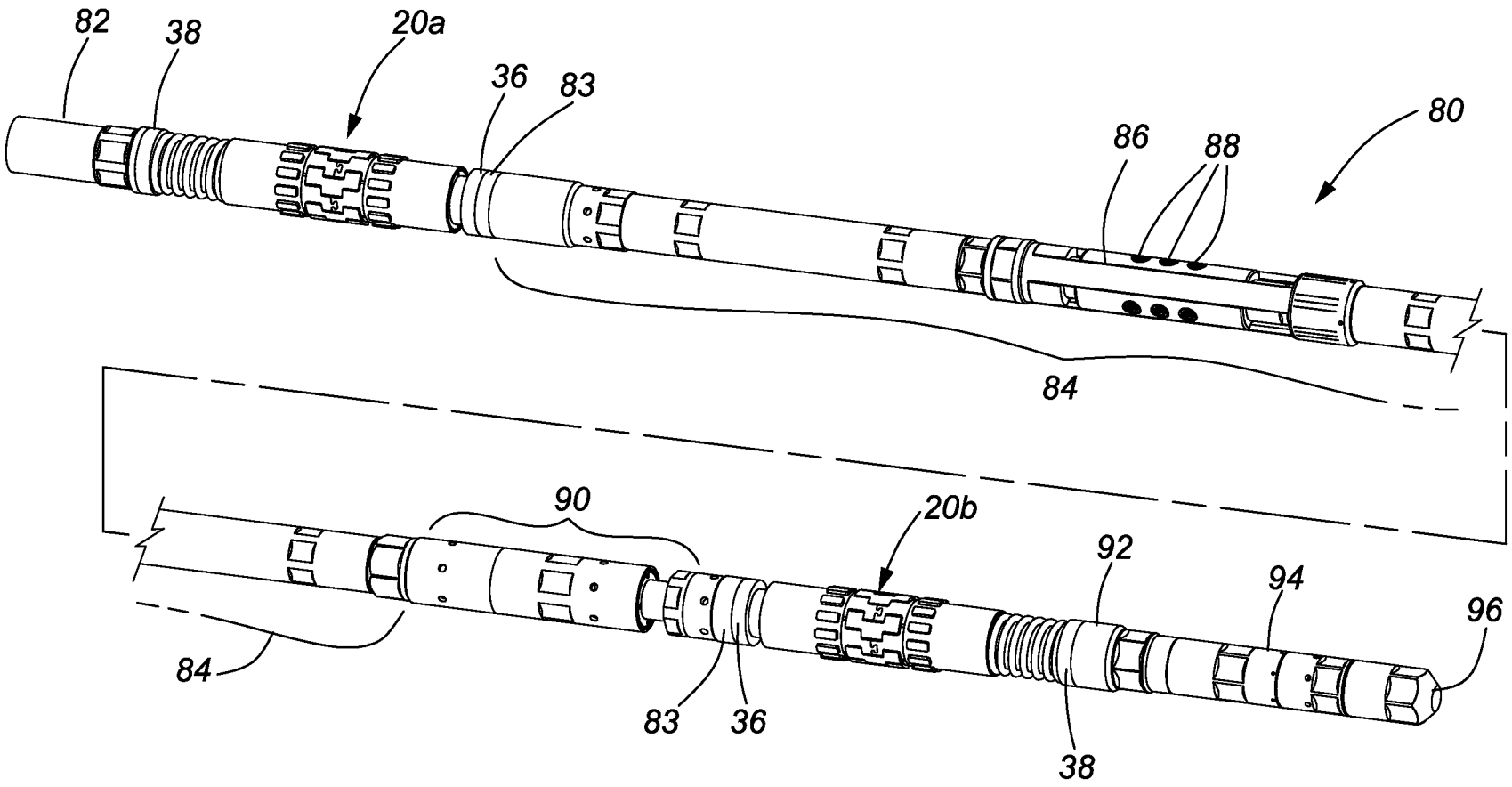
FIG. 10 is a perspective view of the straddle packer shown in FIG. 8 in an expanded or seal-set condition.

FIG. 10 is a perspective view of the straddle packer 80 shown in FIG. 8 in the seal-set condition. In the seal set condition, the uphole seal assembly 20*a* and the downhole seal assembly 20*b* are expanded and contact the well casing 56 (see FIG. 6). During use, the straddle packer 80 is run into a selected location in a cased well bore or relocated to a selected location in the cased well bore using any known reckoning method. When the selected location has been straddled, fluid is pumped down through a work string connected to the work string connection 82 and into the central passage 99 (See FIG. 10) to move the respective seal assemblies 20*a*, 20*b* to the seal-set condition, as will be explained below with reference to FIG. 11.

Figure 11:
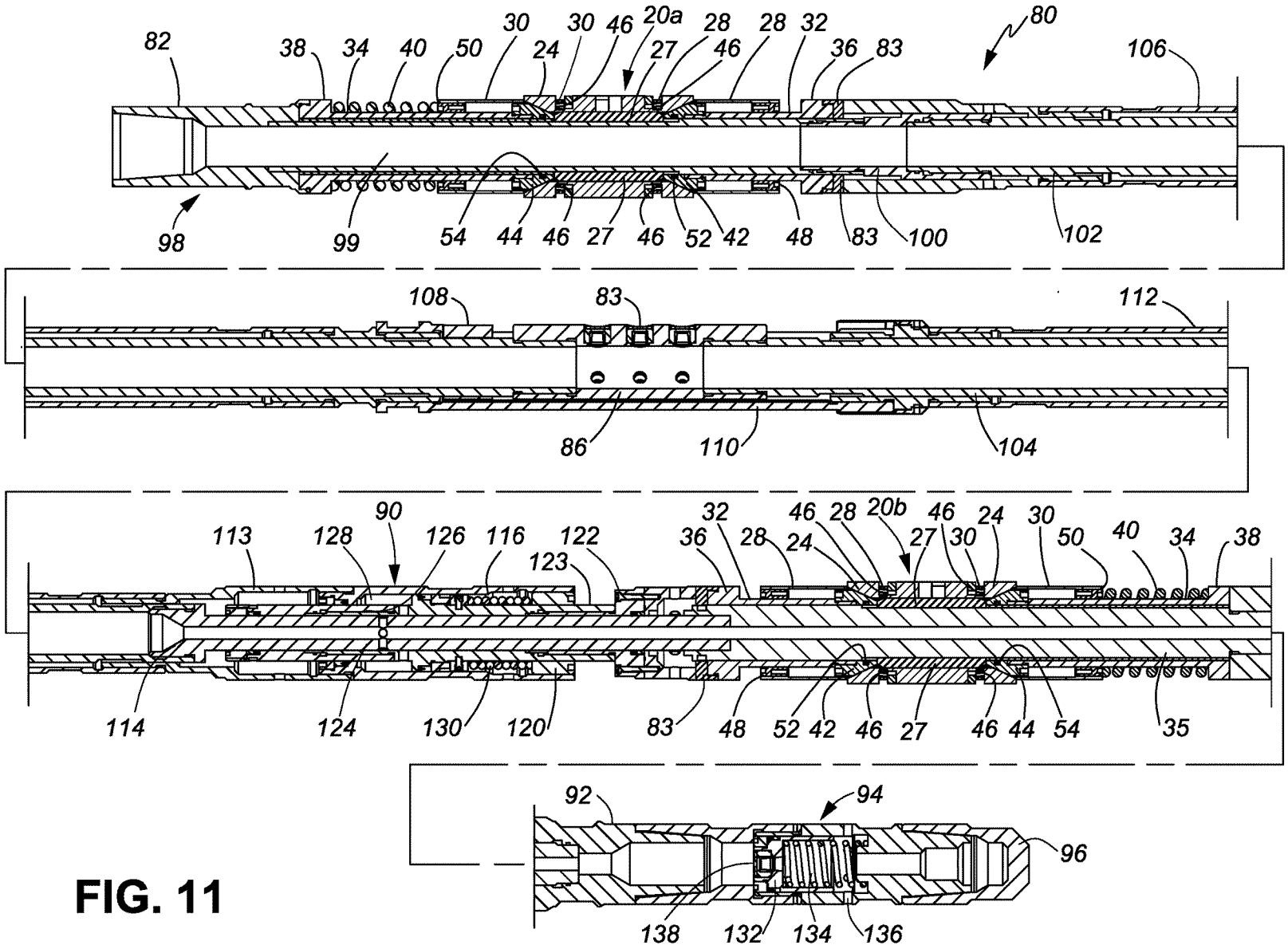
FIG. 11 is a cross-sectional view of the straddle packer shown in FIG. 10.

FIG. 11 is a cross-sectional view of the straddle packer 80 shown in FIG. 10. The seal assemblies 20*a*, 20*b*, are urged to the seal-set condition and remain in the seal set condition so long as high pressure stimulation fluid is pumped into the central passage 99 at a rate greater than a predetermined threshold flow rate. If the pumped fluid remains below the predetermined threshold, governed by a size of the velocity bypass valve orifice 138, the pumped fluid flows through the central passage 99 and out through the injector nozzles 88 and the velocity bypass valve ports 136, which is useful to expel debris from the central passage 99. When the flow rate of the pumped fluid exceeds the predetermined threshold, the velocity bypass valve 132 overcomes the bias of the velocity bypass valve spring 134 and closes the velocity bypass valve ports 136. When the velocity bypass valve ports 136 are closed, fluid pressure rapidly builds in the central passage 99 and the pumped fluid is forced into the piston chamber 128. As the pumped fluid enters the piston chamber 128, the piston sleeve 116 is urged uphole and the force generator piston 123 is urged downhole compressing the force generator return spring 130. Uphole movement of the force generator piston sleeve 116 urges the sliding sleeve section 84 to move the uphole seal assembly 20*a* to the seal-set condition, while downhole movement of the force generator piston 123 urges the mandrel crossover adapter 122 to slide over the force generator piston support component 114, which urges the downhole seal assembly 20*b* to the seal-set condition.

When fluid pumping is terminated, the force generator return spring 130, the respective reactive coil springs 40 of seal assemblies 20*a*, 20*b* and the respective leveling springs 46 of the seal assemblies 20*a*, 20*b* return the respective seal assemblies to the run-in condition and the straddle packer 80 can be moved to another location in the cased well bore or pulled out of the cased well bore. Since the portions of the seal assemblies 20*a*, 20*b* directly exposed to extreme fluid pressures are constructed of rigid, fatigue-resistant material, the seal assemblies 20*a*, 20*b* have a long service life and can be readily constructed of or coated with sour-service materials for use in very corrosive downhole environments.

The explicit embodiments of the invention described above have been presented by way of example only. The scope of the invention is therefore intended to be limited solely by the scope of the appended claims.

We claim:

1. A wear-resistant annular seal assembly, comprising:

an inner mandrel adapted to support an active seal mandrel and a reactive seal mandrel;

an active segment cone on an end of the active seal mandrel and a reactive segment cone on an end of the reactive seal mandrel;

an active seal sleeve adapted to reciprocate on the active seal mandrel and a reactive seal sleeve adapted to reciprocate on the reactive seal mandrel;

a plurality of interlocking seal segments supported on one end by the active segment cone and on an opposite end by the reactive segment cone, the one end being retained on the active segment cone by the active seal sleeve and the opposite end being retained on the reactive segment cone by the reactive seal sleeve;

a reactive coil spring that constantly urges the reactive seal sleeve to urge the interlocking seal segments to a run-in condition; and a segment underseal adapted to expand upwardly in contact with a bottom surface of the interlocking seal segments as the interlocking seal segments are urged to a seal-set condition.

2. The wear-resistant seal assembly as claimed in claim 1 wherein the interlocking seal segments comprise a one-part seal segment having a main body portion with a longitudinal axis and a segment offset on one side of the main body portion and a segment offset notch opposite the segment offset.

3. The wear-resistant seal assembly as claimed in claim 2 wherein the interlocking seal segments further comprise a two-part seal segment having a main body portion with a longitudinal axis and a two-part segment offset on one side of the main body portion with a two-part segment offset notch opposite the two-part segment offset and a dove-tail joint in the two-part segment offset.

4. The wear-resistant seal assembly as claimed in claim 3 further comprising flow path obstructors that project laterally from each side of each end of the two-part seal segments to obstruct a gap between the interlocking seal segments in the seal-set condition.

5. The wear-resistant seal assembly as claimed in claim 4 wherein the one-part seal segments and the two-part seal segments are interleaved.

6. The wear-resistant seal assembly as claimed in claim 1 wherein the one end of the interlocking seal segments is retained on the active segment cone by segment stabilizer lugs on the one end that are captured in stabilizer lug slots in the active seal sleeve and by segment stabilizer lugs on the opposite end that are captured in stabilizer lug slots in the reactive seal sleeve.

7. The wear-resistant seal assembly as claimed in claim 6 wherein the segment stabilizer lugs and the stabilizer lug slots respectively have a rounded rectangle shape in plan view.

8. The wear-resistant seal assembly as claimed in claim 7 further comprising a first coil spring captured in a leveling spring notch in the one end of each of the respective interlocking seal segments and retained in the leveling spring notch by the active seal sleeve and a second coil spring captured in another leveling spring notch in the opposite end of each of the respective interlocking seal segments and retained in the other leveling spring notch by the reactive seal sleeve.

9. The wear-resistant seal assembly as claimed in claim 1 wherein the segment underseal comprises an elastomeric tubular sleeve supported by the seal assembly inner mandrel between the active segment cone and the reactive segment cone.

10. The wear-resistant seal assembly as claimed in claim 9 wherein the segment underseal comprises a heat, fatigue and wear resistant elastomeric polymer or polymer blend.

11. The wear-resistant seal assembly as claimed in claim 3 wherein the one-part seal segments and the two-part seal segments are respectively coated with a fluoropolymer.

12. The wear-resistant seal assembly as claimed in claim 1 wherein the reactive coil spring is in pre-load compression of at least 2,000 pounds.

13. A wear-resistant annular seal assembly comprising a plurality of interlocking seal segments, wherein the interlocking seal segments comprise one-part seal segments interleaved between two-part seal segments having parts interconnected by a dovetail joint, each interlocking seal segment being supported on a first end by an active segment cone and on a second end by a reactive segment cone, each interlocking seal segment having a top surface with a stabilizer lug on each of the first and second ends, the stabilizer lug on the first end of each seal segment being received in a respective stabilizer lug slot in an active seal sleeve that is adapted to reciprocate on an active seal mandrel connected to the active segment cone, and the stabilizer lug on the second end of each seal segment being received in a respective stabilizer lug slot in a reactive seal sleeve adapted to reciprocate on a reactive seal mandrel connected to the reactive segment cone.

14. The wear-resistant annular seal assembly as claimed in claim 13 further comprising an elastomeric tubular underseal supported between the active segment cone and the reactive segment cone on a seal assembly inner mandrel that supports the active segment cone and the reactive segment cone.

15. The wear-resistant seal assembly as claimed in claim 13 wherein the interlocking seal segments comprise a main body portion with a longitudinal axis, a segment offset on one side of the main body portion and a segment offset notch on the other side of the main body portion opposite the segment offset.

16. The wear-resistant seal assembly as claimed in claim 15 wherein the main body portion of the two-part seal segments is longer than the main body portion of the one-part seal segments and further comprises a laterally extending flow path obstructor on each side of each end of the main body portion.

17. A straddle packer comprising:

first and second spaced-apart wear-resistant annular seal assemblies, the respective first and second wear-resistant annular seal assemblies comprising a plurality of interlocking seal segments comprising one-part seal segments interleaved between two-part seal segments with a dovetail joint that interconnects the two parts, each seal segment being supported on a first end by an active segment cone and on an opposite end by a reactive segment cone, the first end of each seal segment being retained on the active segment cone by an active seal sleeve that engages a seal segment stabilizer lug at the first end of the seal segment, and the opposite end of each seal segment being retained on the reactive segment cone by a reactive seal sleeve that engages a seal segment stabilizer lug on the opposite end of the seal segment, the interlocking seal segments being adapted to move radially outwardly from a run-in condition to a seal-set condition when an axial force urges the active segment cone towards the reactive segment cone, and an elastomeric segment underseal sleeve supported on a seal assembly inner mandrel between the active segment cone and the reactive segment cone, the elastomeric segment underseal sleeve being adapted to radially expand into sealing engagement with a bottom surface of the respective interlocking seal segments as the seal segments move radially outwardly from the run-in condition to the seal-set condition.

18. The straddle packer as claimed in claim 17 further comprising an injector sub with injector nozzles between the first and second spaced-apart wear-resistant annular seal assemblies.

19. The straddle packer as claimed in claim 17 further comprising a piston housing connected to the first wear-resistant annular seal assembly and a piston connected to the second wear-resistant annular seal assembly, the piston housing urging the first wear-resistant annular seal assembly from the run-in condition to the seal-set condition when high-pressure fluid is pumped into the straddle packer and the piston urging the second wear-resistant annular seal assembly to the seal-set condition when the high-pressure fluid is pumped into the straddle packer.

* * * * *